US008374372B2

(12) United States Patent
Lee

(10) Patent No.: US 8,374,372 B2
(45) Date of Patent: Feb. 12, 2013

(54) HEADSET

(75) Inventor: Gun-Woo Lee, Gumi-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1238 days.

(21) Appl. No.: 12/174,835

(22) Filed: Jul. 17, 2008

(65) Prior Publication Data

US 2009/0086991 A1 Apr. 2, 2009

(30) Foreign Application Priority Data

Sep. 28, 2007 (KR) ..... 10-2007-0098159

(51) Int. Cl.
*H04R 25/00* (2006.01)

(52) U.S. Cl. ..... 381/370; 381/372; 381/374

(58) Field of Classification Search ..... None
See application file for complete search history.

(56) References Cited

U.S. PATENT DOCUMENTS

| | | | | |
|---|---|---|---|---|
| 6,704,429 | B2 * | 3/2004 | Lin | 381/380 |
| 6,728,386 | B1 * | 4/2004 | Andersen | 381/345 |
| 7,227,957 | B2 * | 6/2007 | Cheng | 381/71.6 |
| 2005/0123161 | A1 * | 6/2005 | Polany et al. | 381/334 |
| 2008/0159554 | A1 * | 7/2008 | Sung et al. | 381/71.6 |
| 2008/0166007 | A1 * | 7/2008 | Hankey et al. | 381/380 |
| 2009/0034748 | A1 * | 2/2009 | Sibbald | 381/71.6 |
| 2010/0080400 | A1 * | 4/2010 | Sibbald et al. | 381/71.6 |

FOREIGN PATENT DOCUMENTS

| | | |
|---|---|---|
| KR | 100496907 | 6/2005 |
| KR | 100496908 | 6/2005 |
| KR | 1020050106079 | 8/2005 |
| KR | 1020060113603 | 2/2006 |

* cited by examiner

*Primary Examiner* — Marlo Fletcher
(74) *Attorney, Agent, or Firm* — H.C. Park & Associates, PLC

(57) ABSTRACT

Provided is a headset including a main housing and a speaker housing that are integrally formed with each other and a rear-side sound-leakage preventing section to shield sound emitted towards a rear side of a speaker. To this end, the headset includes a main housing integrally formed with a speaker housing that protrudes from the main housing, at least one rear-side sound-leakage preventing unit engaged with an inner side of the speaker housing to shield sound emitted towards a rear side of a speaker, and a mounting unit to sequentially couple the speaker and the at least one rear-side sound-leakage preventing unit to the inner side of the speaker housing and mount the at least one rear-side sound-leakage preventing units in the inner side of the speaker housing.

18 Claims, 6 Drawing Sheets

HEADSET

CROSS-REFERENCE TO RELATED PATENT APPLICATION

This application claims priority from and the benefit of Korean Patent Application No. 10-2007-0098159, filed on Sep. 28, 2007, which is hereby incorporated by reference for all purposes as if fully set forth herein.

BACKGROUND OF THE INVENTION

1. Field of the Invention

The present invention relates to a headset, and in particular, to a headset including a main housing integrally formed with a speaker housing and a rear-side sound-leakage preventing section to shield sound emitted towards a rear side of a speaker.

2. Discussion of the Background

Typically, a headset is mounted on any of various digital devices to convert an electric signal into an audio signal for delivery. In line with various functions of portable terminals, a headset may be used for calls, music appreciation, and TV viewing. Recently, headsets using Bluetooth® have been developed, wherein the Bluetooth® technology allows real-time data communication by wirelessly connecting wireless communication devices in a short-distance range with low power consumption.

FIG. 1 is an exploded perspective view of a conventional headset 10. As shown in FIG. 1, the conventional headset 10 includes a pair of cases 11 that can be separated from or coupled to each other, a speaker housing 12 coupled to the cases 11 and including a speaker (not shown), and an engaging housing 13 to fix the speaker housing 12 and the cases 11. The conventional headset 10 further includes an engagement member 16, such as a screw, to fix the cases 11 and the engaging housing 13 disposed on a front surface of the cases 11, and a bonding unit 15 to bond a coupled portion between the engaging housing 13 and the cases 11 to prevent sound leakage. A sound-leakage preventing rubber 14 is included between the engaging housing 13 and the speaker housing 12 to prevent sound leakage through a coupled portion between the engaging housing 13 and the speaker housing 12.

As described above, however, a conventional headset includes various parts such as cases, a speaker, a speaker housing, an engaging housing, an engagement member, a rubber, and a bonding unit, requiring a number of processes for mounting the various parts. As a result, there may be a large number of assembly processes for assembling the parts, which may make the headset manufacturing process complicated. Moreover, the cost of the headset increases due to the increased number of assembly processes. Furthermore, sound may leak from an engaged portion of each part. Therefore, there is a need for a headset capable of preventing sound leakage through coupled portions. In addition, due to sound leakage occurring in a rear side of the speaker, echoes and sound pressure are generated inside the headset. As a result, to prevent the echoes and sound pressure, a separate device may need to be included in the headset and, aside from a need for bonding, various parts may have to be additionally included in the headset. For this reason, the number of assembly processes may increase and manufacturing costs may also increase accordingly.

SUMMARY OF THE INVENTION

The present invention provides a headset in which a speaker housing is formed integrally with a main housing to prevent sound leakage and to simplify and thus facilitate the assembly process of the headset.

The present invention also provides a headset in which a speaker housing, which includes a speaker, is integrally formed with a main housing of the headset to simplify an assembly process and reduce the unit cost of the headset.

The present invention also provides a headset that may prevent the generation of echoes and sound pressure in the headset caused by sound leakage towards a rear side of a speaker.

Additional features of the invention will be set forth in the description which follows, and in part will be apparent from the description, or may be learned by practice of the invention.

The present invention discloses a headset including a main housing formed integrally with a speaker housing that protrudes from the main housing, at least one rear-side sound-leakage preventing unit engaged with an inner side of the speaker housing to shield sound emitted towards a rear side of a speaker, and a mounting unit to sequentially couple the speaker and the at least one rear-side sound-leakage preventing unit to the inner side of the speaker housing and mount the at least one rear-side sound-leakage preventing unit in the inner side of the speaker housing.

The present invention also discloses a headset including a main housing integrally formed with a speaker housing that protrudes from the main housing, a mounting unit arranged at an intersection of the speaker housing and the main housing, and a rear-side sound-leakage preventing section disposed on the mounting unit to shield sound emitted towards a rear side of a speaker included in the speaker housing.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
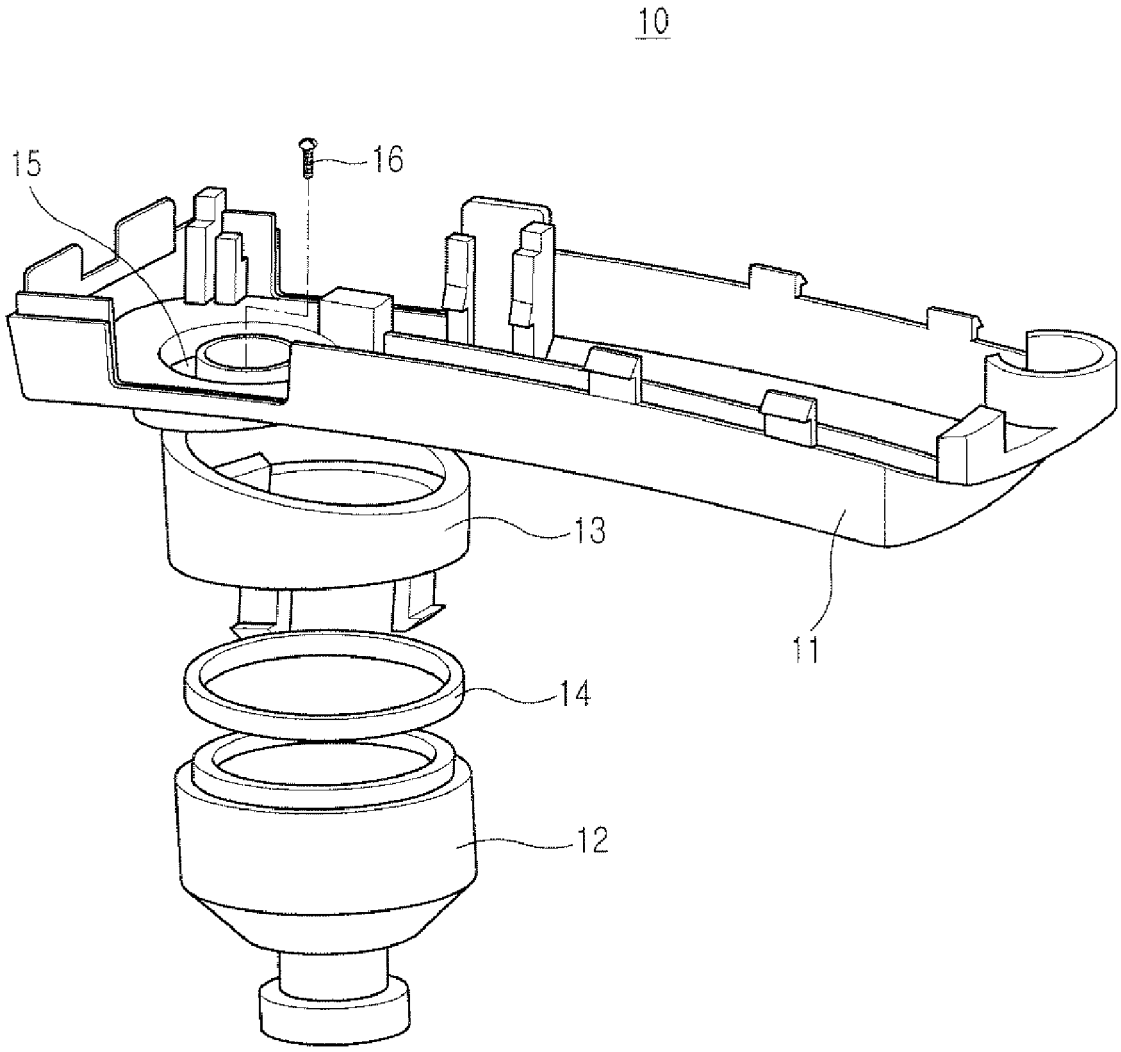
FIG. 1 is an exploded perspective view of a conventional headset.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. Like reference numerals in the drawings denote like elements.

Figure 2:
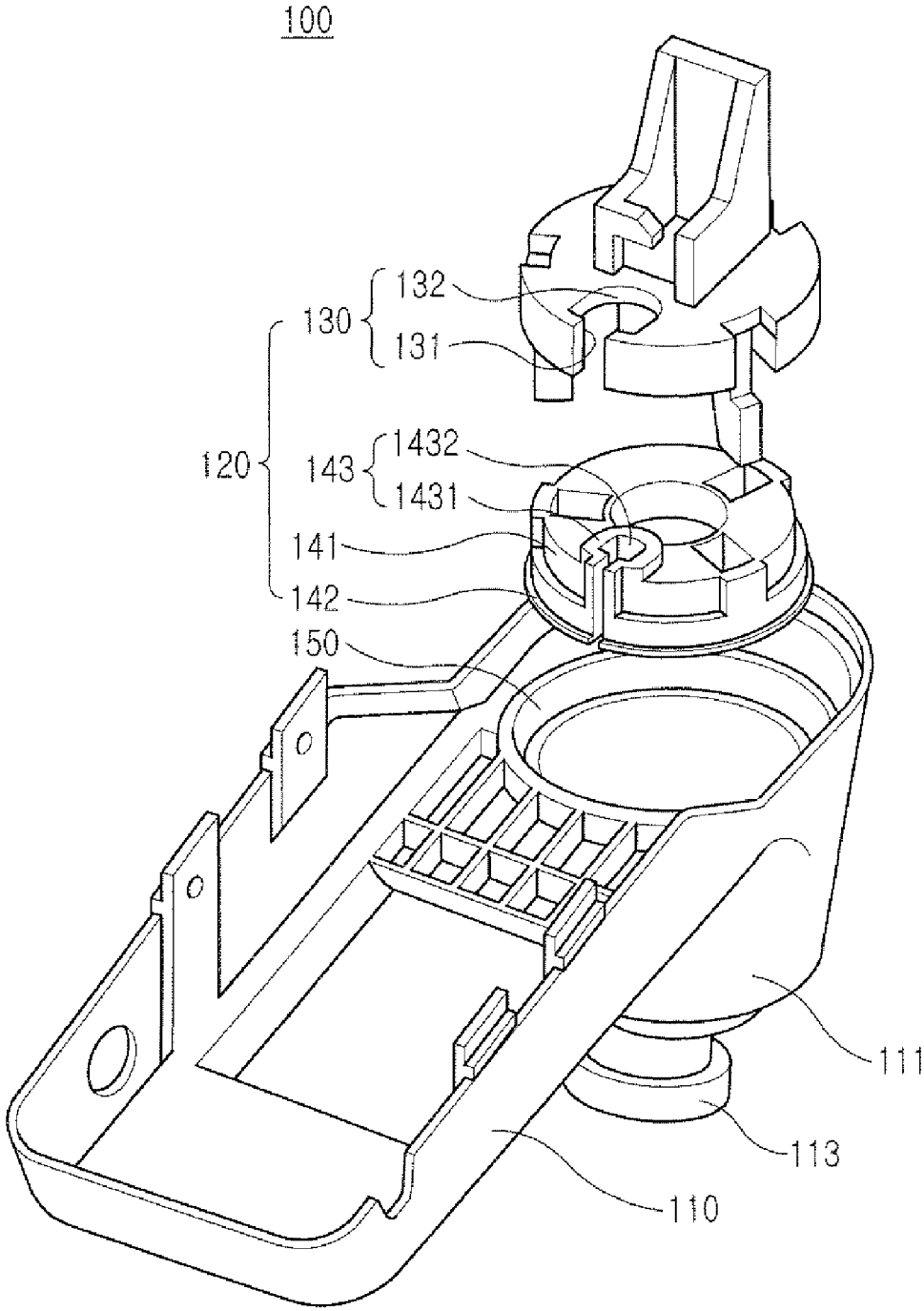
FIG. 2 is an exploded perspective view of a headset according to an exemplary embodiment of the present invention.
Figure 3:
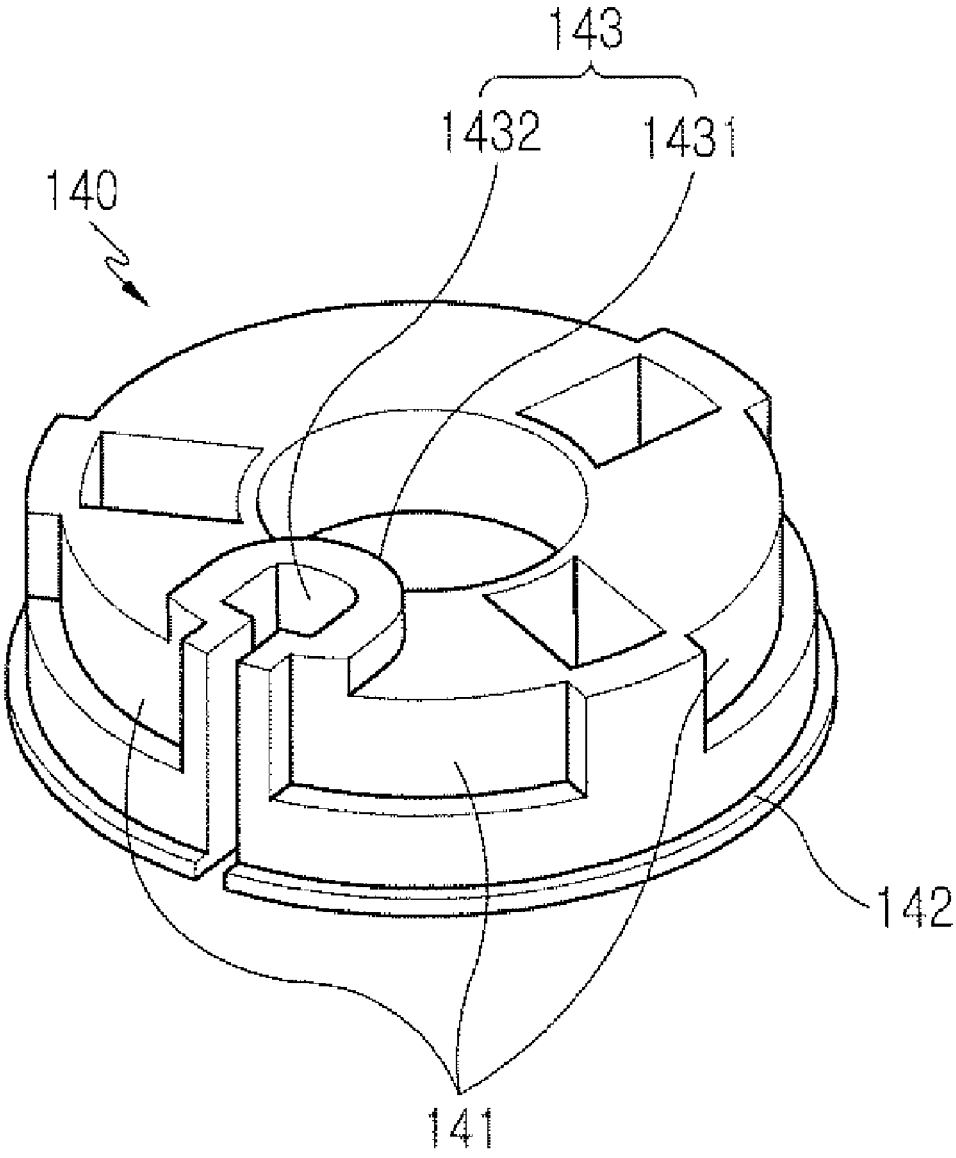
FIG. 3 is an enlarged perspective view of a second rear-side sound-leakage preventing unit of a headset according to an exemplary embodiment of the present invention.
Figure 5:
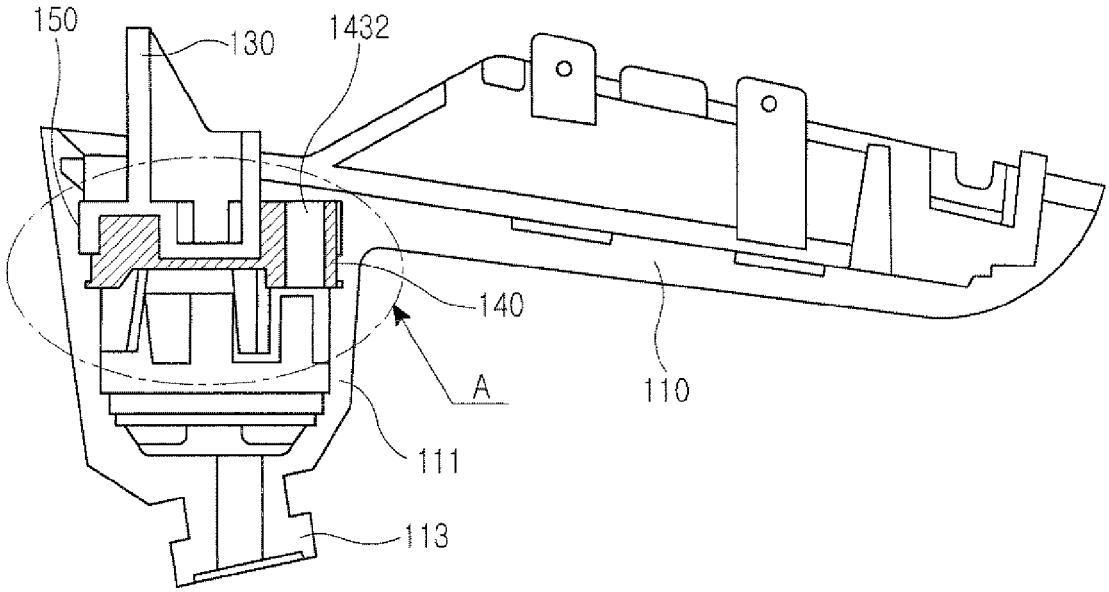
FIG. 5 is a side cross-sectional view showing an assembled state of a headset according to an exemplary embodiment of the present invention.

As shown in FIG. 2 and FIG. 5, a headset 100 includes a main housing 110, a rear-side sound-leakage preventing section 120, and a mounting unit 150. A speaker housing 111, which protrudes from the main housing 110, is formed integrally with the main housing 110, and the rear-side sound-leakage preventing section 120 includes rear-side sound-leakage preventing units in positions engaged with each other in an inner side of the speaker housing 111. The rear-side sound-leakage preventing section 120 shields sound emitted towards a rear side of a speaker included in the speaker housing 111. The mounting unit 150 sequentially couples the speaker and the rear-side sound-leakage preventing units of the rear-side sound-leakage preventing section 120 to the inner side of the speaker housing 111 and mounts the rear-side sound-leakage preventing units of the rear-side sound-leakage preventing section 120 in the inner side of the speaker housing 111.

As shown in FIG. 2, FIG. 3, FIG. 4, and FIG. 5, the rear-side sound-leakage preventing units of the rear-side sound-leakage preventing section 120 may include a first rear-side sound-leakage preventing unit 130 and a second rear-side sound-leakage preventing unit 140. The first rear-side sound-leakage preventing unit 130 is included in the mounting unit 150 to spatially separate an inner side of the main housing 110 from an inner side of the speaker housing 111 and to shield sound emitted towards the rear side of the speaker, and the second rear-side sound-leakage preventing unit 140 is mounted on one surface of the first rear-side sound-leakage preventing unit 130 and contacts an inner periphery of the speaker housing 111 to shield sound emitted towards in the rear side of the speaker.

Figure 4:
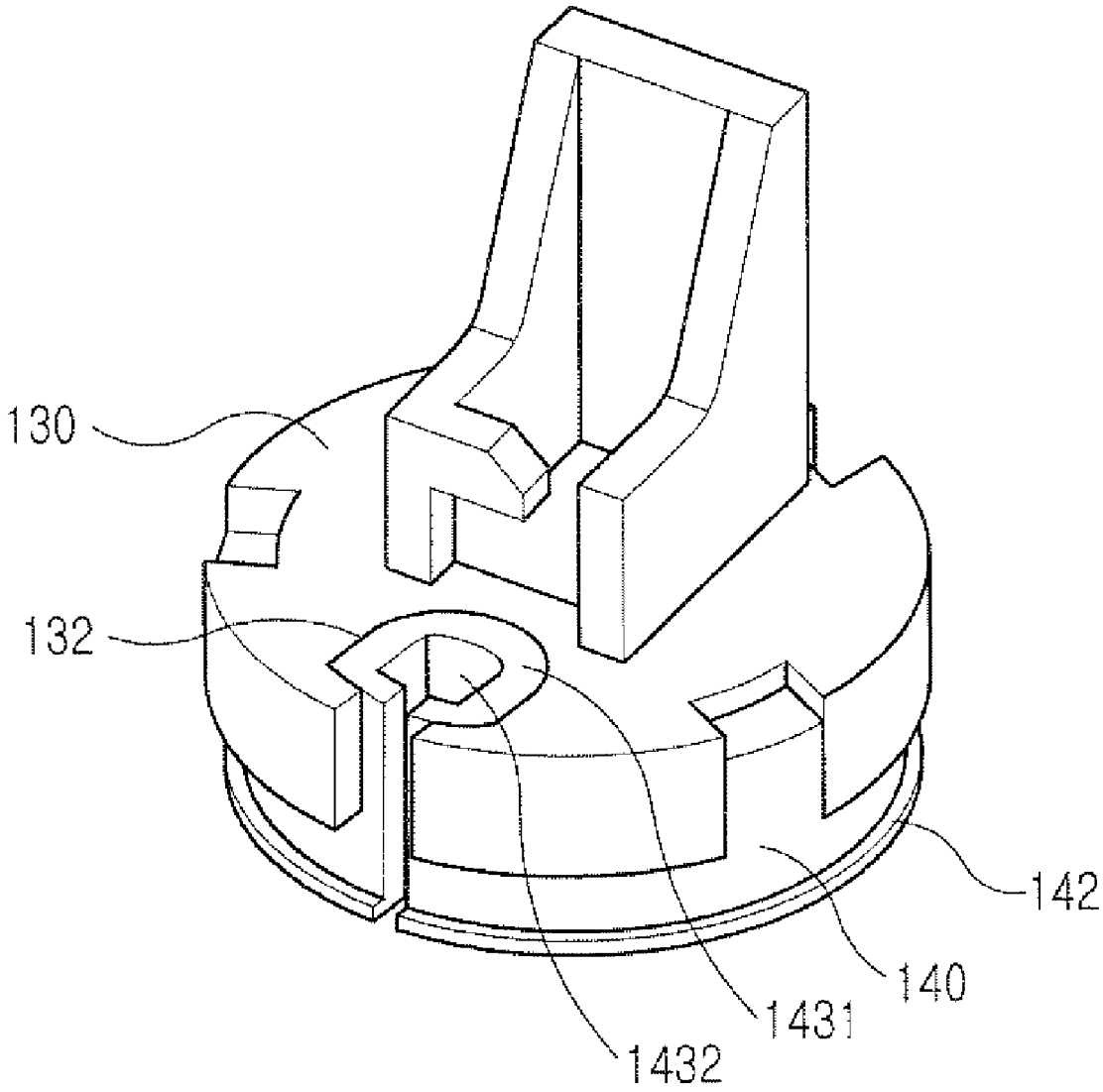
FIG. 4 is a perspective view showing a coupled state of a first rear-side sound-leakage preventing unit and a second rear-side sound-leakage preventing unit of a headset according to an exemplary embodiment of the present invention.

As shown in FIG. 2, FIG. 3, FIG. 4, and FIG. 5, the first rear-side sound-leakage preventing unit 130 may be made of polycarbonate, and the second rear-side sound-leakage preventing unit 140 may be made of a rubber member. As shown in FIG. 2, FIG. 4, FIG. 5, and FIG. 6, a groove 131 is formed in one surface of the first rear-side sound-leakage preventing unit 130. The second rear-side sound-leakage preventing unit 140 may be inserted into the groove 131, such that an inner periphery of the first rear-side sound-leakage preventing unit 130 and an outer periphery of the second rear-side sound-leakage preventing unit 140 are engaged with each other. As shown in FIG. 2, FIG. 4, and FIG. 5, a through-hole 132 is formed in the first rear-side sound-leakage preventing unit 130 and a speaker wire (not shown) to electrically connect a printed circuit board inside the main housing 110 with the speaker inside the speaker housing 111 passes through the through-hole 132. As shown in FIG. 2, FIG. 3, FIG. 4, and FIG. 5, an insertion protrusion portion 143 is provided on one surface of the second rear-side sound-leakage preventing unit 140 facing the first rear-side sound-leakage preventing unit 130, so that the insertion protrusion portion 143 may be inserted into the through-hole 132 and may allow the speaker wire to penetrate therethrough.

Figure 6:
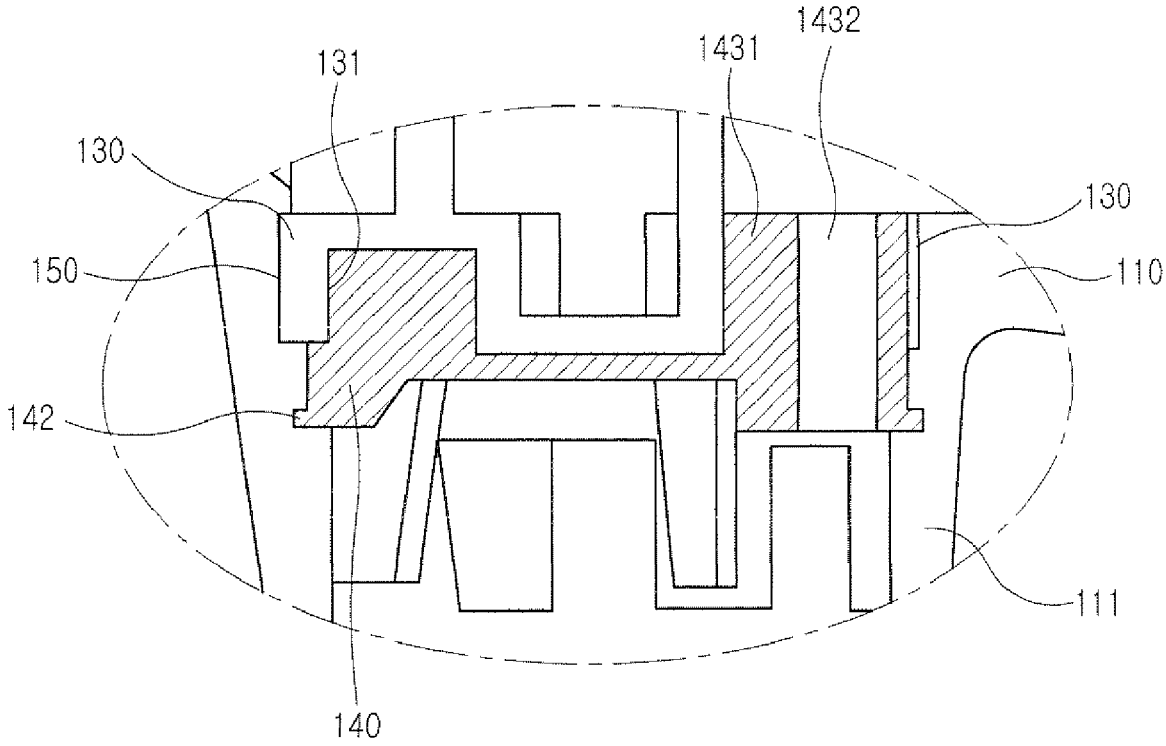
FIG. 6 is an enlarged side cross-sectional view of portion 'A' shown in FIG. 5.

As shown in FIG. 2, FIG. 3, FIG. 4, and FIG. 5, the insertion protrusion portion 143 includes an insertion protrusion 1431 and a hole 1432. The insertion protrusion 1431 protrudes from one face of the second rear-side sound-leakage preventing unit 140, so that the insertion protrusion 1431 is inserted into and in contact with an inner periphery of the through-hole 132. The hole 1432 is included in the insertion protrusion 1431 to allow the speaker wire to penetrate therethrough and contact the hole 1432. As shown in FIG. 2, FIG. 3, FIG. 4, and FIG. 5, an insertion portion 141 is disposed on one face of the second rear-side sound-leakage preventing unit 140, so that the second rear-side sound-leakage preventing unit 140 is inserted into the groove 131 of the first rear-side sound-leakage preventing unit 130 and contacts an inner periphery of the first rear-side sound-leakage preventing unit 130. The insertion portion 141 also protrudes from one face of the second rear-side sound-leakage preventing unit 140 to be inserted into and engaged with the groove 131. As shown in FIG. 2, FIG. 3, FIG. 4, FIG. 5, and FIG. 6, a single-step portion 142 is provided along an outer periphery on another-side face of the second rear-side sound-leakage preventing unit 140. The single-step portion 142 protrudes from an outer periphery of the second rear-side sound-leakage preventing unit 140 to be engaged with and in contact with the speaker housing 111. As shown in FIG. 2, FIG. 5, and FIG. 6, the mounting unit 150 includes a mounting groove arranged along the inner periphery of the speaker housing 111 in order to be engaged with an outer periphery of the rear-side sound-leakage preventing section 120. The mounting groove forms a single step inside the speaker housing 111.

With reference to FIG. 2, FIG. 3, FIG. 4, FIG. 5, and FIG. 6, a detailed description will now be made of an operation of the headset 100 according to an exemplary embodiment of the present invention. As shown in FIG. 2, the speaker housing 111 protrudes from the main housing 110 for insertion into a user's ear, wherein the speaker housing 111 protrudes from one face of the main housing 110 and is integrally formed with the main housing 110. As shown in FIG. 2, FIG. 3, FIG. 4, and FIG. 5, an earpiece 113 to output sound is integrated with the speaker housing 111 at an edge end of the speaker housing 111. For example, a soft rubber member (not shown) may be included along a circumference of an edge end of the earpiece 113 in order to be softly inserted into the user's ear while being fixed together with the earpiece 113. To radiate transmitted or received sound data towards the earpiece 113, a speaker (not shown) may be included inside the speaker housing 111. As shown in FIG. 2, the speaker, the second rear-side sound-leakage preventing unit 140, and the first rear-side sound-leakage preventing unit 130 are sequentially mounted inside the speaker housing 111. The first rear-side sound-leakage preventing unit 130 may be made of polycarbonate and the second rear-side sound-leakage preventing unit 140 may be made of a rubber member. Thus, the interior of the main housing 110 and the interior of the speaker housing 111 are spaced apart from each other by coupling the inner periphery of the first rear-side sound-leakage preventing unit 130 to the mounting groove 150. In addition, the generation of sound leakage in the speaker towards the main housing 110 may be prevented by the rear-side sound-leakage preventing section 120 and the main housing 110 may contact an inner side of the speaker housing 111 due to the second rear-side sound-leakage preventing unit 140, which may be made of the rubber member. As shown in FIG. 4, the insertion portion 141 protruding from one face of the second rear-side sound-leakage preventing unit 140 is inserted into and contacts the groove 131 of the first rear-side sound-leakage preventing unit 130. The insertion protrusion 1431 protruding from one face of the second rear-side sound-leakage preventing unit 140 is inserted into the through-hole 132 formed in the first rear-side sound-leakage preventing unit 130, and the outer periphery of the insertion protrusion 1431 and the inner periphery of the through-hole 132 are in contact with each other. In this state, as shown in FIG. 2, the speaker, the second rear-side sound-leakage preventing unit 140, and the first rear-side sound-leakage preventing unit 130 are sequentially mounted inside the speaker housing 111.

Once the outer periphery of the first rear-side sound-leakage preventing unit 130 is mounted in order to be inserted into and engaged with the mounting groove 150 of the speaker housing 111, the outer periphery of the first rear-side sound-leakage preventing unit 130 is engaged with the mounting groove 150 and the single-step portion 142 protruding from the outer periphery of the second rear-side sound-leakage preventing unit 140 is closely contacted with the inner periphery of the speaker housing 111. The interior of the main housing 110 and the interior of the speaker housing 111 are spaced apart from each other by the rear-side sound-leakage preventing section 120. The speaker wire (not shown) to connect the printed circuit board (not shown) included in the main housing 110 with the speaker penetrates the hole 1432 of the second rear-side sound-leakage preventing unit 140. Sound generated in the speaker may be prevented from being introduced into the inner side of the main housing 110 by the rear-side sound-leakage preventing section 120 and is radiated only towards the earpiece 113 and generation of echoes or sound pressure caused by sound emitted towards the rear side of the speaker is prevented. Moreover, since the speaker housing 111 and the main housing 110 are integrally formed, sound leakage through a coupled portion, occurring in conventional headsets, may be prevented. Furthermore, the hole 1432 to connect the inner side of the speaker housing 111 with the inner side of the main housing 110 is formed in the insertion protrusion portion 141 inserted into and contacting the through-hole 132.

As the second rear-side sound-leakage preventing unit 140 may be made of a rubber member, the outer periphery of the hole 1432 may also be made of the rubber member. The speaker wire penetrates from the inner side of the speaker housing 111 towards the inner side of the main housing 110 through the hole 1432 and the hole 1432 is engaged with and contacts an outer side of the speaker wire. Thus, sound leakage generated in the speaker wire may also be prevented.

As is apparent from the foregoing description, in the headset according to exemplary embodiments of the present invention, the speaker housing and the main housing are formed integrally, which may reduce the number of assembly parts for the headset, simplify the assembly process thereof, and reduce the unit cost and manufacturing cost of the headset. Moreover, sound leakage occurring in coupled portions between parts may be prevented. By providing the rear-side sound-leakage preventing section, sound radiated to the rear side of the speaker is shielded, thereby preventing the generation of echoes and sound pressure in the headset. Furthermore, the insertion protrusion portion of the second rear-side sound-leakage preventing unit is inserted into the through-hole of the first rear-side sound-leakage preventing unit and contacts the speaker wire penetrating from the speaker towards the inner side of the main housing, which may prevent the generation of sound leakage in the speaker wire.

The above-described headset is not limited to the foregoing embodiment and drawings. For example, although the second rear-side sound-leakage preventing unit is inserted into and in contact with the first rear-side sound-leakage preventing unit in the foregoing exemplary embodiment of the present invention, the second rear-side sound-leakage preventing unit may be surrounded by the outer periphery of the first rear-side sound-leakage preventing unit to be engaged with the inner side of the speaker housing. In addition, while the first rear-side sound-leakage preventing unit and the second rear-side sound-leakage preventing unit may be made of polycarbonate and a rubber member, respectively, they may also be made of any material capable of preventing sound leakage in the speaker. Moreover, although the speaker housing is shown to have a cylindrical shape, it may also have a taper shape, such that the circumference of a cylinder decreases in a direction from the main housing towards the earpiece.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A headset, comprising:

a main housing integrally formed with a speaker housing that protrudes from the main housing;

at least one rear-side sound-leakage preventing unit engaged with an inner side of the speaker housing to shield sound emitted towards a rear side of a speaker; and a mounting unit to sequentially couple the speaker and the at least one rear-side sound-leakage preventing unit to the inner side of the speaker housing and mount the at least one rear-side sound-leakage preventing unit in the inner side of the speaker housing, wherein the mounting unit comprises a mounting groove along the inner periphery of the speaker housing to engage with an outer periphery of the rear-side sound-leakage preventing section, the mounting groove forming a single step inside the speaker housing.

2. The headset of claim 1, wherein the at least one rear-side sound-leakage preventing unit comprises:

a first rear-side sound-leakage preventing unit to space an interior of the main housing apart from an interior of the speaker housing and to shield the sound emitted towards the rear side of the speaker; and a second rear-side sound-leakage preventing unit mounted on a surface of the first rear-side sound-leakage preventing unit and in contact with an inner periphery of the speaker housing in order to shield the sound emitted towards the rear side of the speaker.

3. The headset of claim 2, wherein the first rear-side sound-leakage preventing unit is made of polycarbonate, and the second rear-side sound-leakage preventing unit is made of a rubber member.

4. The headset of claim 3, wherein the second rear-side sound-leakage preventing unit is inserted in a groove formed in the first rear-side sound-leakage preventing unit, such that an inner periphery of the first rear-side sound-leakage preventing unit and an outer periphery of the second rear-side sound-leakage preventing unit are engaged with each other, and wherein a through-hole is formed in the first rear-side sound-leakage preventing unit to allow a speaker wire to electrically connect a printed circuit board inside the main housing with the speaker.

5. The headset of claim 4, wherein an insertion protrusion portion is provided on a surface of the second rear-side sound-leakage preventing unit facing the first rear-side sound-leakage preventing unit, the insertion protrusion portion being inserted into the through-hole and allowing the speaker wire to penetrate therethrough.

6. The headset of claim 5, wherein the insertion protrusion portion comprises:

an insertion protrusion protruding from a face of the first rear-side sound-leakage preventing unit and inserted into and in contact with an inner periphery of the through-hole; and a hole included in the insertion protrusion to allow the speaker wire to penetrate therethrough and be in contact therewith.

7. The headset of claim 4, wherein an insertion portion is disposed on a face of the second rear-side sound-leakage preventing unit and inserted into and engaged with the groove of the first rear-side sound-leakage preventing unit and in contact with an inner periphery of the first rear-side sound-leakage preventing unit.

8. The headset of claim 2, wherein a single-step portion is provided along an outer periphery of the second rear-side sound-leakage preventing unit, the single-step portion protruding to be engaged with and in contact with the speaker housing.

9. The headset of claim 1, wherein the mounting unit is integrally formed with the main housing and the speaker housing.

10. A headset, comprising:

a main housing integrally formed with a speaker housing that protrudes from the main housing;

a mounting unit arranged at an intersection of the speaker housing and the main housing; and a rear-side sound-leakage preventing section disposed on the mounting unit to shield sound emitted towards a rear side of a speaker included in the speaker housing, wherein the mounting unit comprises a mounting groove along the inner periphery of the speaker housing to engage with an outer periphery of the rear-side sound-leakage preventing section, the mounting groove forming a single step inside the speaker housing.

11. The headset of claim 10, wherein the rear-side sound-leakage preventing section comprises:

a first rear-side sound-leakage preventing unit to space an interior of the main housing apart from an interior of the speaker housing; and a second rear-side sound-leakage preventing unit mounted on a surface of the first rear-side sound-leakage preventing unit and in contact with an inner periphery of the speaker housing.

12. The headset of claim 11, wherein the first rear-side sound-leakage preventing unit is made of polycarbonate, and the second rear-side sound-leakage preventing unit is made of a rubber member.

13. The headset of claim 12, wherein the second rear-side sound-leakage preventing unit is inserted in a groove formed in the first rear-side sound-leakage preventing unit, such that an inner periphery of the first rear-side sound-leakage preventing unit and an outer periphery of the second rear-side sound-leakage preventing unit are engaged with each other, and wherein a through-hole is formed in the first rear-side sound-leakage preventing unit to allow a speaker wire to electrically connect a printed circuit board inside the main housing with the speaker.

14. The headset of claim 13, wherein an insertion protrusion portion is provided on a surface of the second rear-side sound-leakage preventing unit facing the first rear-side sound-leakage preventing unit, the insertion protrusion portion being inserted into the through-hole and allowing the speaker wire to penetrate therethrough.

15. The headset of claim 14, wherein the insertion protrusion portion comprises:

an insertion protrusion protruding from a face of the first rear-side sound-leakage preventing unit and inserted into and in contact with an inner periphery of the through-hole; and a hole included in the insertion protrusion to allow the speaker wire to penetrate therethrough and be in contact therewith.

16. The headset of claim 13, wherein an insertion portion is disposed on a face of the second rear-side sound-leakage preventing unit and inserted into and engaged with the groove of the first rear-side sound-leakage preventing unit and in contact with an inner periphery of the first rear-side sound-leakage preventing unit.

17. The headset of claim 11, wherein a single-step portion is provided along an outer periphery of the second rear-side sound-leakage preventing unit, the single-step portion protruding to be engaged with and in contact with the speaker housing.

18. The headset of claim 10, wherein the mounting unit is integrally formed with the main housing and the speaker housing.

* * * * *